US009291354B2

(12) United States Patent
Brantley et al.

(10) Patent No.: US 9,291,354 B2
(45) Date of Patent: Mar. 22, 2016

(54) HOME APPLIANCE WITH TREATED WINDOW AND METHOD FOR TREATING THE WINDOW

(71) Applicant: BSH Home Appliances Corporation, Irvine, CA (US)

(72) Inventors: Matthew Brantley, Maryville, TN (US); Jason Campbell, Pioneer, TN (US); Gary Hill, Jacksboro, TN (US); James O'Neal Taylor, Jacksboro, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 410 days.

(21) Appl. No.: 13/711,709

(22) Filed: Dec. 12, 2012

(65) Prior Publication Data

US 2014/0158109 A1 Jun. 12, 2014

(51) Int. Cl.
*F24C 15/04* (2006.01)
*F24C 15/02* (2006.01)

(52) U.S. Cl.
CPC ..... *F24C 15/04* (2013.01); *F24C 15/023* (2013.01)

(58) Field of Classification Search
CPC ..... B24C 1/04; B24C 1/06; B24C 11/00; B44C 3/005
USPC ..... 451/29, 31
See application file for complete search history.

(56) References Cited

U.S. PATENT DOCUMENTS

| | | | | |
|---|---|---|---|---|
| 3,267,621 | A * | 8/1966 | Meyers et al. | 451/31 |
| 3,267,930 | A * | 8/1966 | Casciani | 126/200 |
| 4,093,754 | A * | 6/1978 | Parsons | 427/259 |
| 6,561,180 | B1 * | 5/2003 | Austin et al. | 126/198 |
| 2002/0079306 | A1 * | 6/2002 | Gros et al. | 219/396 |
| 2004/0211405 | A1 * | 10/2004 | Briedis et al. | 126/200 |
| 2006/0219234 | A1 * | 10/2006 | Larsen | 126/198 |

* cited by examiner

*Primary Examiner* — Monica Carter
*Assistant Examiner* — Lauren Beronja
(74) *Attorney, Agent, or Firm* — James E. Howard; Andre Pallapies

(57) ABSTRACT

A home appliance and method including an appliance body having an oven access opening; an oven door for selectively covering the oven access opening; and a window in the oven door for viewing the oven contents, the window having a treated window portion for obscuring the view of the oven contents behind the treated window portion, the treated window portion being fabricated using a window treatment apparatus for supporting a window for treatment, the window treatment apparatus including a support stand defining a window support area, a blocking element mounted to the window stand for movement into and out of a covering relation with the window support area, the blocking element having a window cover plate having a window cover area smaller in area than the window support area, with the difference in the area of the window support area and the window cover area defining a window treatment area.

16 Claims, 15 Drawing Sheets

HOME APPLIANCE WITH TREATED WINDOW AND METHOD FOR TREATING THE WINDOW

BACKGROUND OF THE INVENTION

The present invention relates broadly to home appliances having treated windows, more particularly, to a home appliance, especially a range, having a door window that is treated to be semi-opaque to opaque over a predetermined portion of the window, and a method for treating the window.

Home appliances, such as ranges, having ovens, steamers, accessory compartments or other openings in the front for user access that are covered by doors that often include viewing windows so that a user can observe the contents of the compartment.

In order to provide an attractive appearance, inner portions of the range that may include unfinished metal and insulation that could otherwise be seen though door window may be hidden by treating a portion of the window. The treated window portion may be an edge portion of the window and the treatment may consist of "frosting" or other obscuring, deformation or other technique that renders the window edge opaque or semi-opaque.

Often, abrasive blasting techniques are used to treat the glass that becomes the window when installed in an oven door. Such treatments can be damaging to the glass and the glass needs to be protected from scratches on the underside as well as on either side of the viewing pane. In addition, current treatment processes tend to be slow operations with such care required to protect the glass.

SUMMARY OF THE INVENTION

It is accordingly an object of the present invention to provide a home appliance having a window glass that is treated around an edge portion to provide an area of frosted glass in a safe and convenient manner using a support stand that provides enhanced glass protection.

It is another object of the present invention to provide such a home appliance with a window glass that is treated using a method and apparatus that quickly adapts to multiple glass sizes.

To those ends, a home appliance, which is preferably a range, includes an appliance body having an internal oven cavity and an oven access opening and an oven door for selectively covering the oven access opening. A window is in the oven door for viewing the oven contents, with the window having a treated window portion for obscuring a view of oven structure located behind the treated window portion. The treated window portion is fabricated using a window treatment apparatus for supporting a window element for treatment. The window treatment apparatus includes a window support stand defining a window support area, and a blocking element mounted to the window stand for movement into and out of a covering relation with the window support area, the blocking element having a window cover plate with a window cover area smaller in area than the window support area, with the difference in the area of the window support area and the window cover area defining a window treatment area.

It is preferred that the home appliance includes the window treated on the window treatment apparatus wherein the window treatment apparatus includes a first blocking element pivotably and removably mountable to the window support frame and a second blocking element pivotably and removably mountable to the window support frame, wherein the first blocking element has a first window cover area and the second blocking element has a second window cover area and the first window cover area is a different size that the second window cover area.

Preferably, the home appliance includes the window treated on the window treatment apparatus by abrasive blasting applied to the window treatment area.

It is further preferred that the home appliance includes the window treated on the window treatment apparatus wherein the window is a glass sheet mounted on the window treatment stand and partially covered by the blocking element, thereby leaving the window treatment area exposed for treatment wherein the treatment includes abrasive blasting. Preferably, the window is treated on the window treatment apparatus wherein the treatment includes abrasive blasting applied to the window treatment area.

It is preferred that the home appliance has one of a first window made from a glass sheet having a first size with a treated window portion with a first size and the treated on the window treatment apparatus using a first blocking element and a second window made from a glass sheet having the first size and a treated window portion having a second size and treated on the window treatment apparatus using a second blocking element.

Preferably, the home appliance has one of a first window made from a glass sheet having a first size and treated on the window treatment apparatus using a first blocking element and a second window made from a glass sheet having a second size and the treated on the window treatment apparatus using a second blocking element.

It is further preferred that the home appliance includes the window treated on the window treatment apparatus wherein the window support stand includes a skeletal base and a window support frame wherein the window support frame is mounted to the skeletal base at an adjustable angular relationship with a horizontal plane.

Preferentially, the home appliance includes the window treated on the window treatment apparatus wherein the treatment apparatus includes a padded surface on one side of the blocking element for abutment with a glass sheet for treatment thereof. It is preferred that the home appliance includes the window treated on the window treatment apparatus wherein the treatment apparatus includes alignment members mounted to one side of the window support frame for alignment of a glass sheet for treatment thereof.

Preferably, the home appliance includes the window treated on the window treatment apparatus wherein the treatment apparatus includes a hinge system for mounting the blocking element on the window support stand. It is further preferred that the hinge system for mounting the blocking element on the window support stand is configured to mount two blocking elements on the window support stand and includes a first hinge portion for association with a first blocking element and a second hinge portion for association with a second blocking element and a common hinge portion for association with both the first blocking element and the second blocking element. Each hinge portion may include a pin mounted to one of the window treatment stand and the blocking element and a pin receiver for receipt of the pin, with the pin receiver being mounted to one of the window treatment stand and the blocking element.

The present invention may also be set forth in terms of a treatment apparatus. To that end, the present invention is directed to an apparatus for use in treating glass for home appliance use including a window support stand defining a window support area, and a blocking element having a window cover plate having a window cover area smaller in area than the window support area, wherein the difference in the area of the window support area and the window cover area define a window treatment area.

Preferably, the apparatus includes a first removable blocking element pivotably mountable to the window support frame and a second blocking element pivotably mountable to the window support frame for movement in and out of a covering relation with a glass sheet for treatment, wherein the first blocking element has a first window cover area and the second blocking element has a second window cover area and the first window cover area is a different size that the second window cover area.

The present invention is also directed to a method for preparing a window for home appliance use. Such a method includes selecting a glass sheet of suitable size for use as a viewing window in the home appliance; mounting the glass sheet to a window treatment apparatus including a window support stand defining a window support area; selecting a blocking element having a cover plate of suitable size to cover a portion of the glass sheet to define a treatment area; mounting the blocking element to the window treatment apparatus wherein the blocking element is movable in and out of a covering relation with a selected portion of the glass sheet; covering a selected portion of the glass sheet with the blocking element by moving the blocking element over the glass sheet; and treating the glass sheet in the defined window treatment area using a treating apparatus.

It is preferred that covering a selected portion of the glass sheet includes using one of a first blocking element pivotably and removably mountable to the window support frame and a second blocking element pivotably and removably mountable to the window support frame, wherein the first blocking element has a first window cover area and the second blocking element has a second window cover area and the first window cover area is a different size that the second window cover area.

Preferably, treating the glass sheet includes applying an abrasive material to the window treatment area.

Moving the blocking element preferably includes moving the blocking element into contact with the glass sheet wherein the window is partially covered by the blocking element, thereby leaving the window treatment area exposed for treatment.

It is further preferred that treating the window includes applying abrasive blasting, particularly applying abrasive blasting to the window treatment area.

Preferentially, selecting a glass sheet includes selecting one of a first window made from a glass sheet having a first size with a treated window portion with a first size to be treated on the window treatment apparatus using a first blocking element and a second window made from a glass sheet having the first size and a treated window portion having a second size to be treated on the window treatment apparatus using a second blocking element.

It is further preferred that selecting a glass sheet includes selecting one of a first window made from a glass sheet having a first size for treatment on the window treatment apparatus using a first blocking element and a second window made from a glass sheet having a second size and for treatment on the window treatment apparatus using a second blocking element.

Preferably, mounting the glass sheet includes mounting the glass sheet on the treatment apparatus wherein the window support stand includes a skeletal base and a window support wherein the window support is mounted to the skeletal base at an adjustable angular relationship with a horizontal plane.

It is preferred that selecting a blocking element includes selecting a blocking element having a padded surface on one side of the blocking element for abutment with a glass sheet for treatment thereof.

Mounting the glass sheet preferably includes mounting the glass sheet on the window treatment apparatus in abutment with alignment members mounted to one side of the window support stand for alignment of a glass sheet for treatment thereof.

Preferentially, mounting the glass sheet includes mounting the glass sheet to a window treatment apparatus wherein the treatment apparatus includes a hinge system for mounting the blocking element on the window support stand.

It is preferred that mounting the glass sheet includes mounting the glass sheet to a window treatment apparatus wherein the hinge system for mounting the blocking element on the window support stand is configured to mount two blocking elements on the window support stand and includes a first hinge portion for association with a first blocking element and a second hinge portion for association with a second blocking element and a common hinge portion for association with both the first blocking element and the second blocking element.

It is further preferred that mounting the glass sheet includes mounting the glass sheet to a window treatment apparatus wherein each hinge portion includes a pin mounted to one of the window treatment stand and the blocking element and a pin receiver for receipt of the pin, with the pin receiver being mounted to one of the window treatment stand and the blocking element.

By the above, the present invention provides a home appliance having a window having a treated portion that is semi-opaque or opaque that can be prepared in a simple and effective manner according to the present method.

DESCRIPTION OF THE PREFERRED EMBODIMENT

Figure 1:
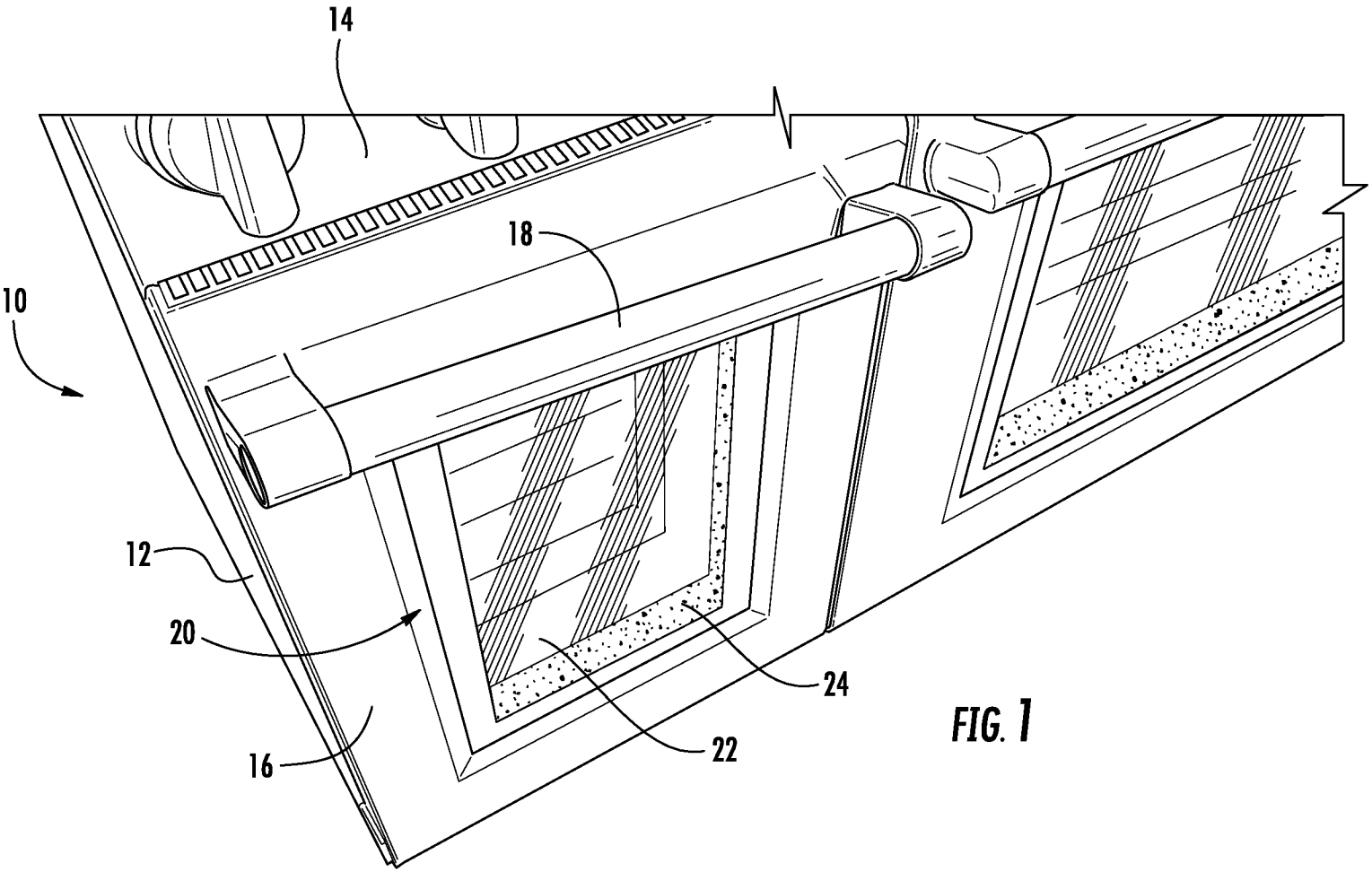
FIG. 1 is an upper perspective view of a home appliance having treated windows according to one preferred embodiment of the present invention.

Turning now to the drawings and more particularly to FIG. 1, a home appliance in the form of a range is illustrated generally at 10 and includes a generally rectangular body 12 having a control panel 14 thereon. The range 10 may include one or more ovens and oven doors below the control panel 14. The range pictured in FIG. 1 includes first oven cavity covered by a first oven door 16 and a second cavity covered by a second oven door adjacent the first oven door 16. The range 10 may also include a steaming chamber or other utility cavity without departing from the present invention.

The oven door 16 may include a cylindrical handle 18 for pivoting the door in and out of covering relation with the oven cavity. The oven door 16 includes a viewing window 20 generally mounted to the center of the oven door 16 for a user's visual access to the contents of the oven cavity.

The window 20 includes a central clear window portion 22 as well as a treated window portion 24 forming an outer edge of the window. The treated window portion is semi-opaque to opaque and may be frosted by an abrasion treatment to prevent direct viewing through the treated portion. The treated portion typically covers unfinished metal, insulation, or other internal components that are not intended for viewing by a user.

As illustrated in FIG. 1, the home appliance 10 may include a second oven cavity with a second door located beside the first door. The second door may include a window that has a different size than the first window 20 or it may include a treated portion having a different size than the treated portion 24 of the first window 20. In addition, the window may be the same size as the first window 20 but include a different size treated portion or the window may include the same size treated portion and a different size window. Therefore, both windows and treated portion borders may appear in multiple sizes.

Figure 2:
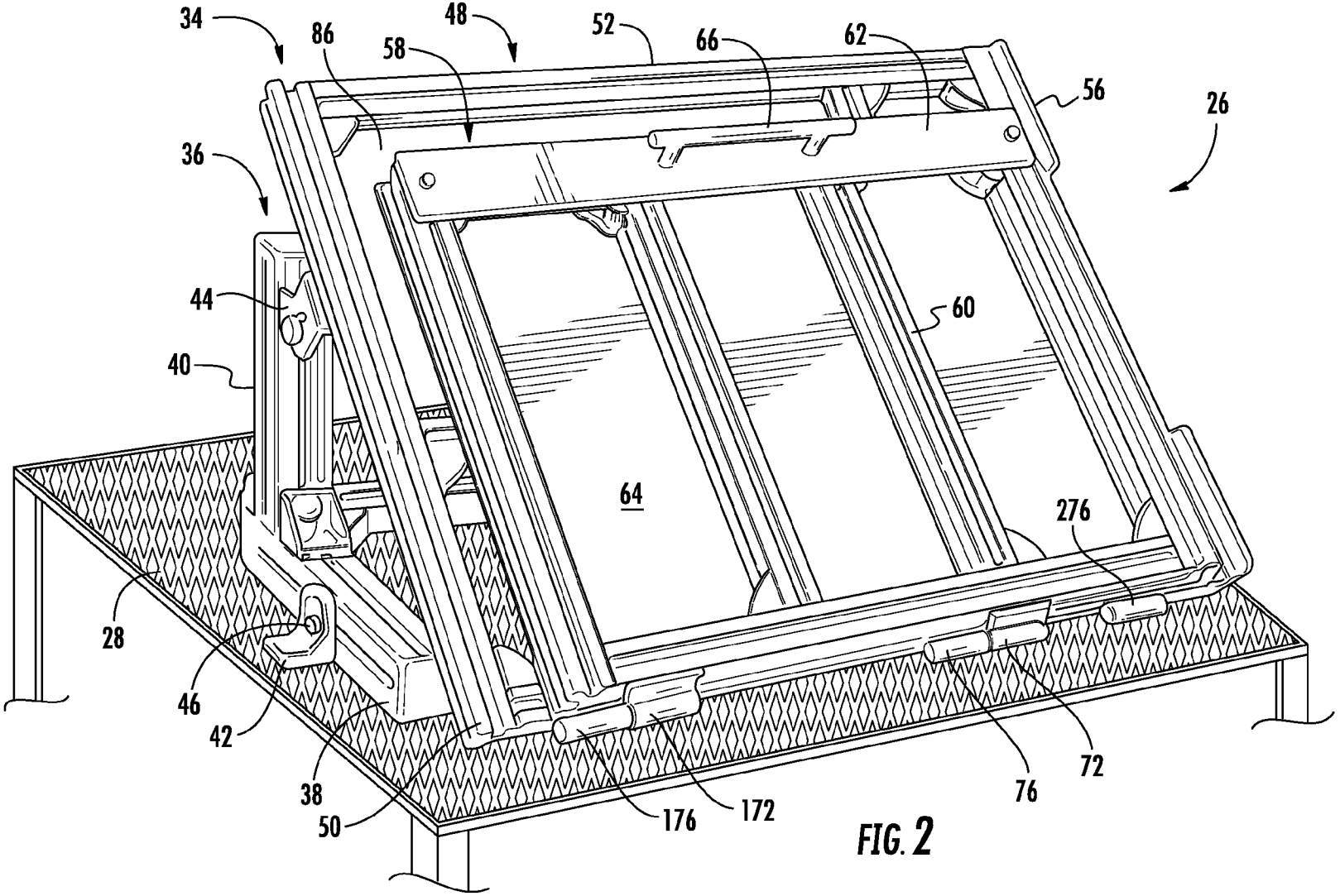
FIG. 2 is a perspective view of a window treatment apparatus used to prepare windows as illustrated in FIG. 1.

Turning now to FIG. 2, a window treatment apparatus is illustrated generally at 26 in an assembled condition. The window treatment apparatus 26 is supported on a support screen 28 which is typically a steel mesh or other metal mesh that supports the window treatment apparatus 26 for abrasive blasting to treat the designated treatment portion of the window as will be seen in greater detail hereinafter. The screen 28 allows the blasting material to fall through to an awaiting bin (not shown) for ease of cleanup and to maintain a neat work surface.

The treatment apparatus 26 includes a window support stand 34. The window support stand is effective in presenting a glass sheet for treatment at a position convenient for treatment by a user of the apparatus. The window support stand 34 includes a skeletal frame 36. The skeletal frame 36 defines a base 38 made from aluminum or other metallic channel material forming a generally U-shaped structure for support on the screen 28. A pair of uprights 40, made from the same channel material, extends vertically from the corners of the base 38 and each upright 40 is attached to the base 38 using angular mounts 42 and bolts 46. The base 38 is also attached to the screen 28 using similar angular mounts 42 and bolts 46. The window stand 34 is mounted to the skeletal frame 36 at an angular relationship using a slider assembly 44 to provide some angular adjustment for the convenience of a user.

A window glass support frame 48 is mounted to the base 38 and is configured as a generally rectangular structure having aluminum or other metallic channel members forming generally vertically side rails 50 separated by generally horizontal side rails 52. A center bar 54, seen in FIG. 3, extends between two vertical side rails 50 to provide additional glass support. Two alignment braces 56 project outwardly from one edge of a vertical side rail 50 for glass abutment thereagainst to align the glass on the glass support frame 48 which adds to the convenience of the system and enhances the ability of the user to treat a glass sheet in an expedient manner.

The present invention provides a window treatment apparatus that not only provides a convenient platform for window treatment, but also features a structure providing the ability to treat a sequence of glass sheets in a consistent and efficient manner. Further, glass sheets of different sizes and different sized treatment areas are readily accommodated. To that end, and will be explained in greater detail hereinafter, two blocking elements 58, 88 are provided to define the window treatment area 86 and protect the viewing area of a glass sheet mounted to a treatment apparatus 26 for treatment. Further, each of the blocking elements 58,88 may be configured to define different sized treatment areas. The blocking elements 58, 88 are interchangeable and are mounted to the window stand 34 using a hinge system 70.

With continued reference to FIG. 2, a first blocking element 58 is formed as a generally rectangular member from the same type of channel material that forms the window stand 34 and skeletal frame 36. The first blocking element 58 includes multiple vertical side rails 60 separated by horizontal side rails 62. The upper horizontal side rail 62 includes a handle 66 for ease of movement of the blocking element 58 in and out of covering relation with a glass sheet mounted to the window stand 34.

Figure 3:
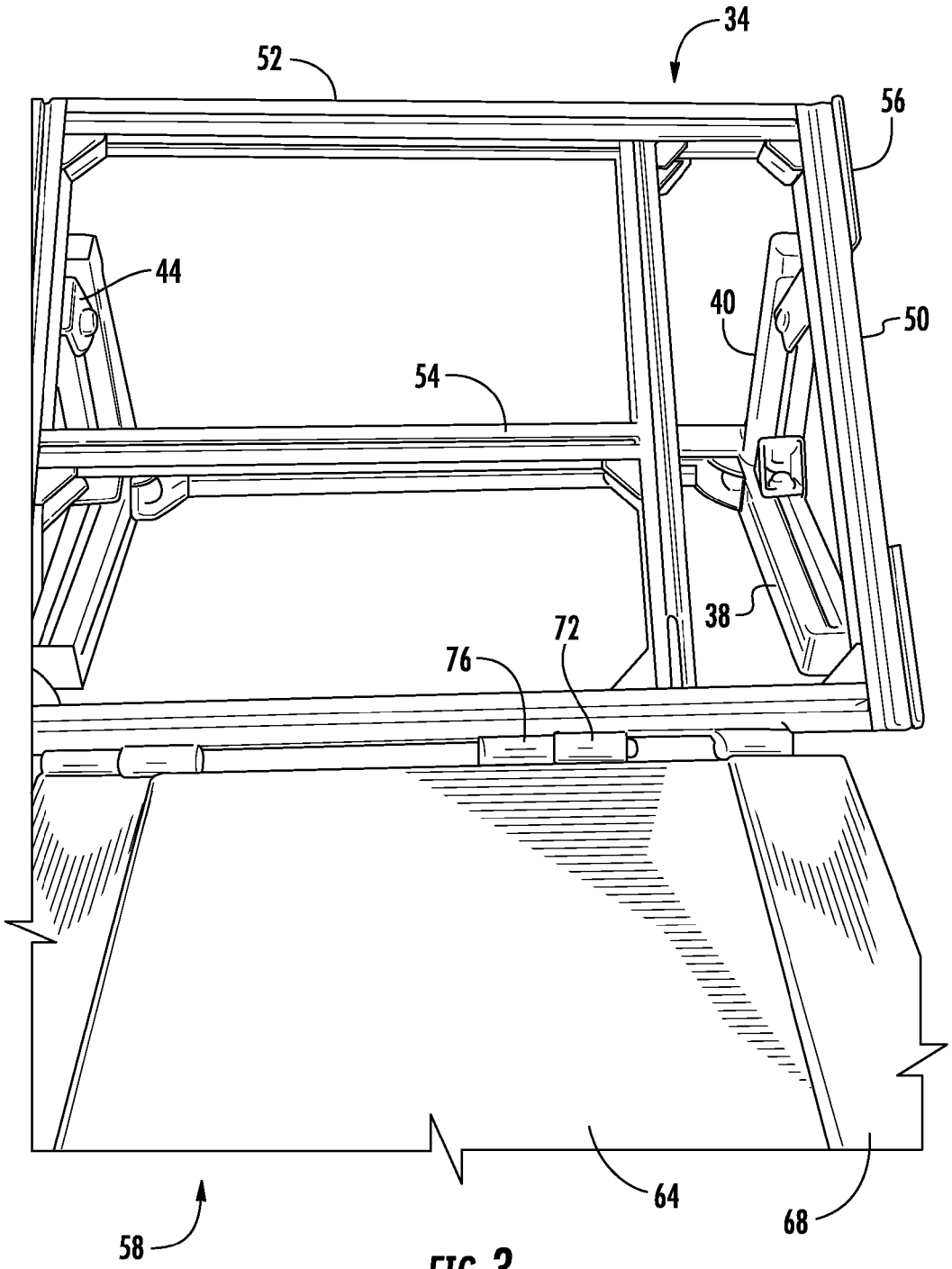
FIG. 3 is a front view of the window treatment apparatus illustrated in FIG. 2 with a blocking element pivoted away from a window support stand.
Figure 4:
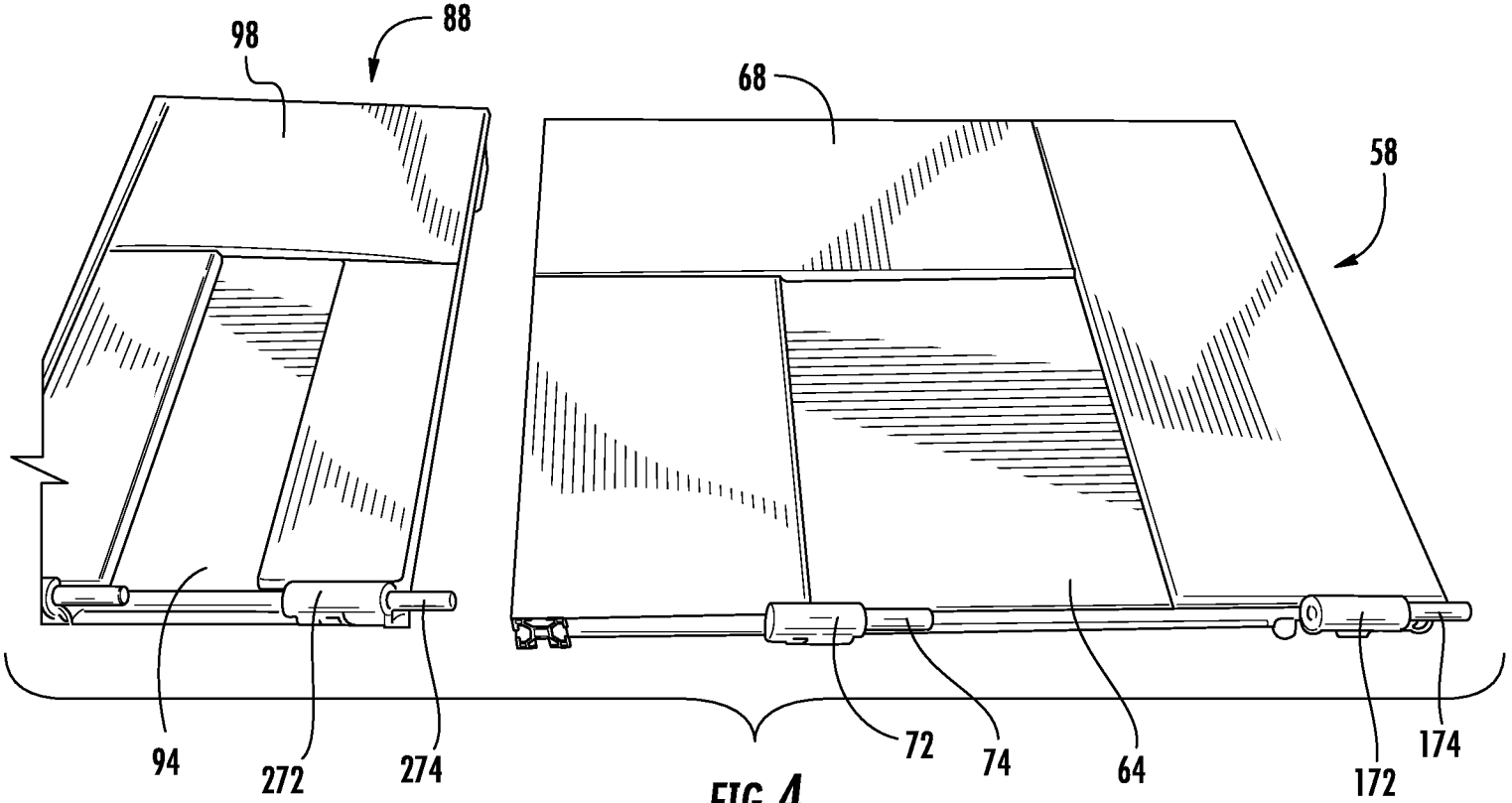
FIG. 4 is a front perspective view of two different sized blocking elements for use on the window treatment apparatus illustrated in FIG. 2.

A generally planar cover plate 64 is mounted to the skeletal framework of the blocking element 58 for covering and protecting a glass sheet on the window stand 34. With reference to FIG. 3, the cover plate 64 includes strips of padding 68 which may be rubber adhesively applied to the cover plate 64 for contact with the glass sheet being treated. With reference to FIG. 4, the second blocking element 88 includes a second cover plate 94 with padding 98 applied thereto a glass sheet in the window frame 34. In order to define different sized treatment areas, each blocking element can be configured with different sized cover plates that act to define different sized treatment areas.

With reference to FIGS. 2, 4, 5, 6 and 7, in order to effectively mount the blocking element 58 to the window stand 34, a hinge system 70 is provided. The hinge system 70 includes two hinge elements 72, 172 on the first blocking element 58, and two hinge elements 72, 272 on the second blocking element 88 and three receivers 76, 176, 276 on the window stand 34. Two of the receivers 176, 276 are used with each blocking element 58, 88 and one hinge receiver 76 is common to both blocking elements 58, 88. Each hinge element 72, 172, 272 has a peg 74, 174, 274 projecting outwardly therefrom for receipt in the receivers 76, 176, 276 as seen in FIG. 4. The receivers 76, 176, 276 are mounted to the window stand 34 along the lower horizontal side rail 52.

Figure 6:
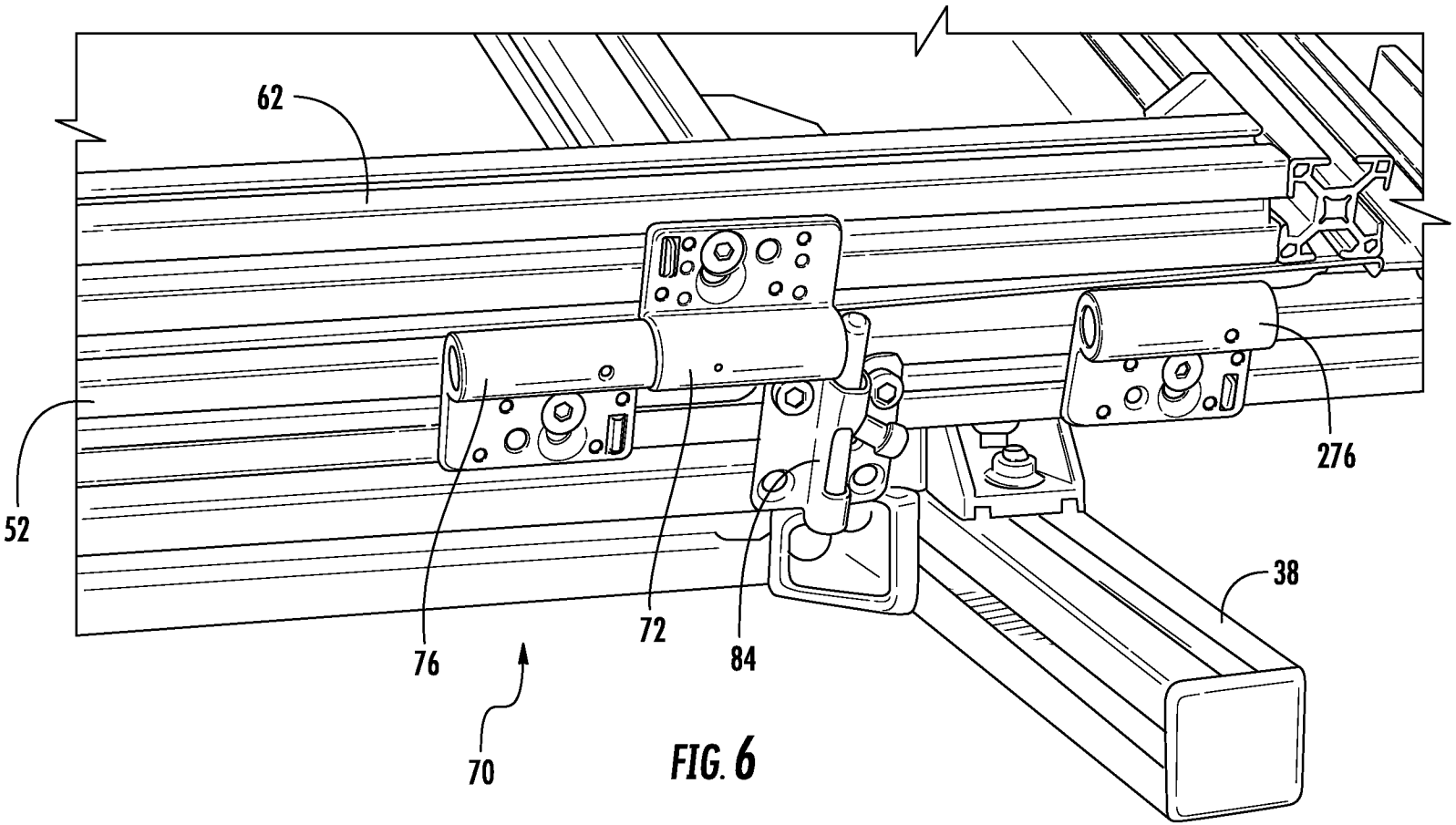
FIG. 6 is a perspective view of the hinge system on the treatment apparatus illustrated in FIG. 2.
Figure 7:
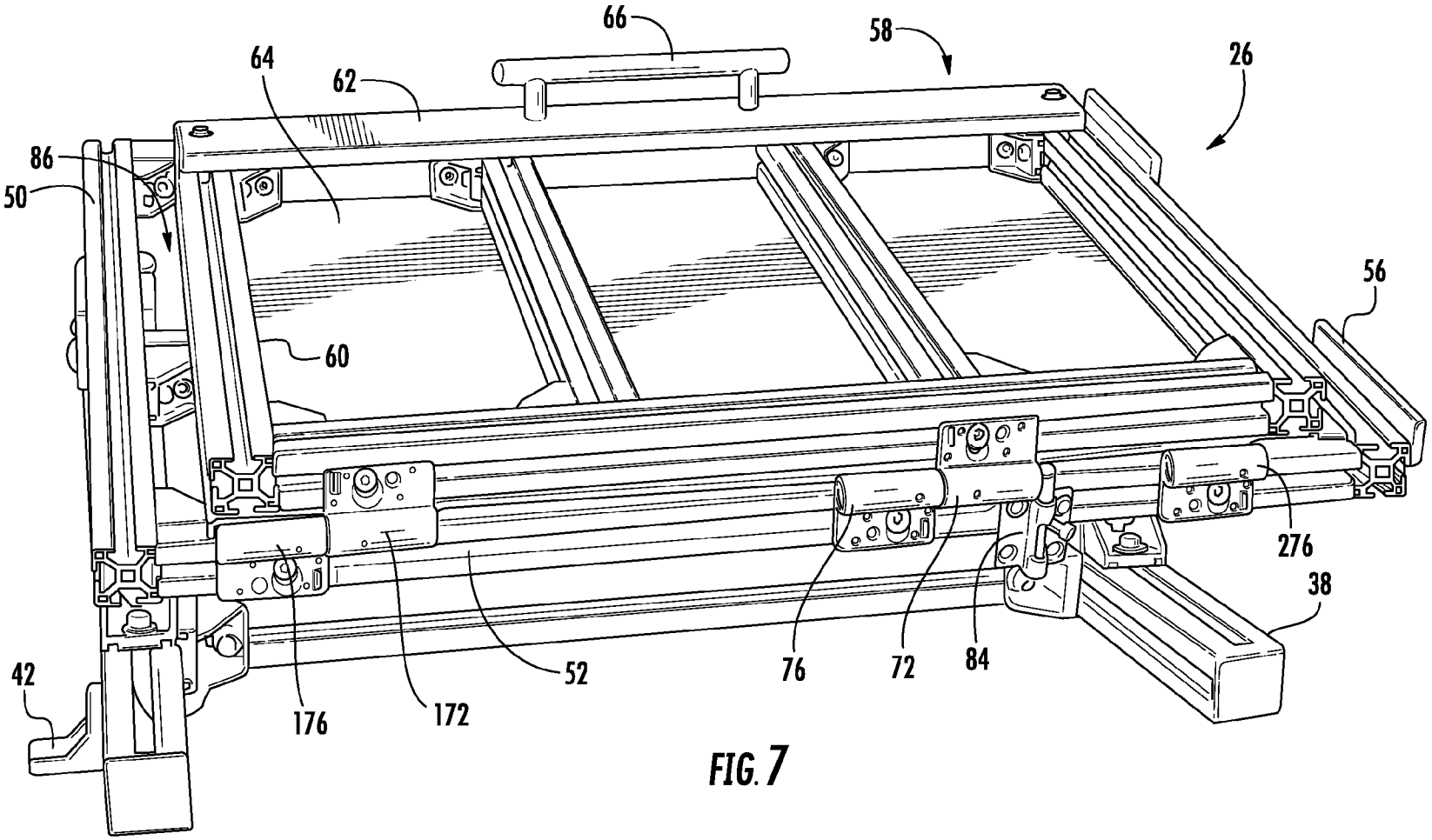
FIG. 7 is a perspective view of a window treatment apparatus having a first blocking element in place.

Turning now to FIG. 6, the hinge system 70 includes a latch 84, operationally associated with the common hinge element 72 and the common receiver 76. The common receiver illustrated in FIG. 6 is shown engaged with the first hinge element 72 of the first blocking element 58. Notably, the latch 84 latches either the first blocking element 58 or the second blocking element 88 in place. FIG. 7 illustrates a situation wherein the first blocking element 58 is latched in place using the common hinge element 72. The left-most receiver 176 and the left-most hinge element 172 are engaged to pivotably mount the first blocking element 58 on the window stand 34. It is a simple matter to change blocking elements by sliding one off the hinge system 70, replacing it with the other blocking element and using the latch 84 to retain the respective blocking element in place.

Figure 11:
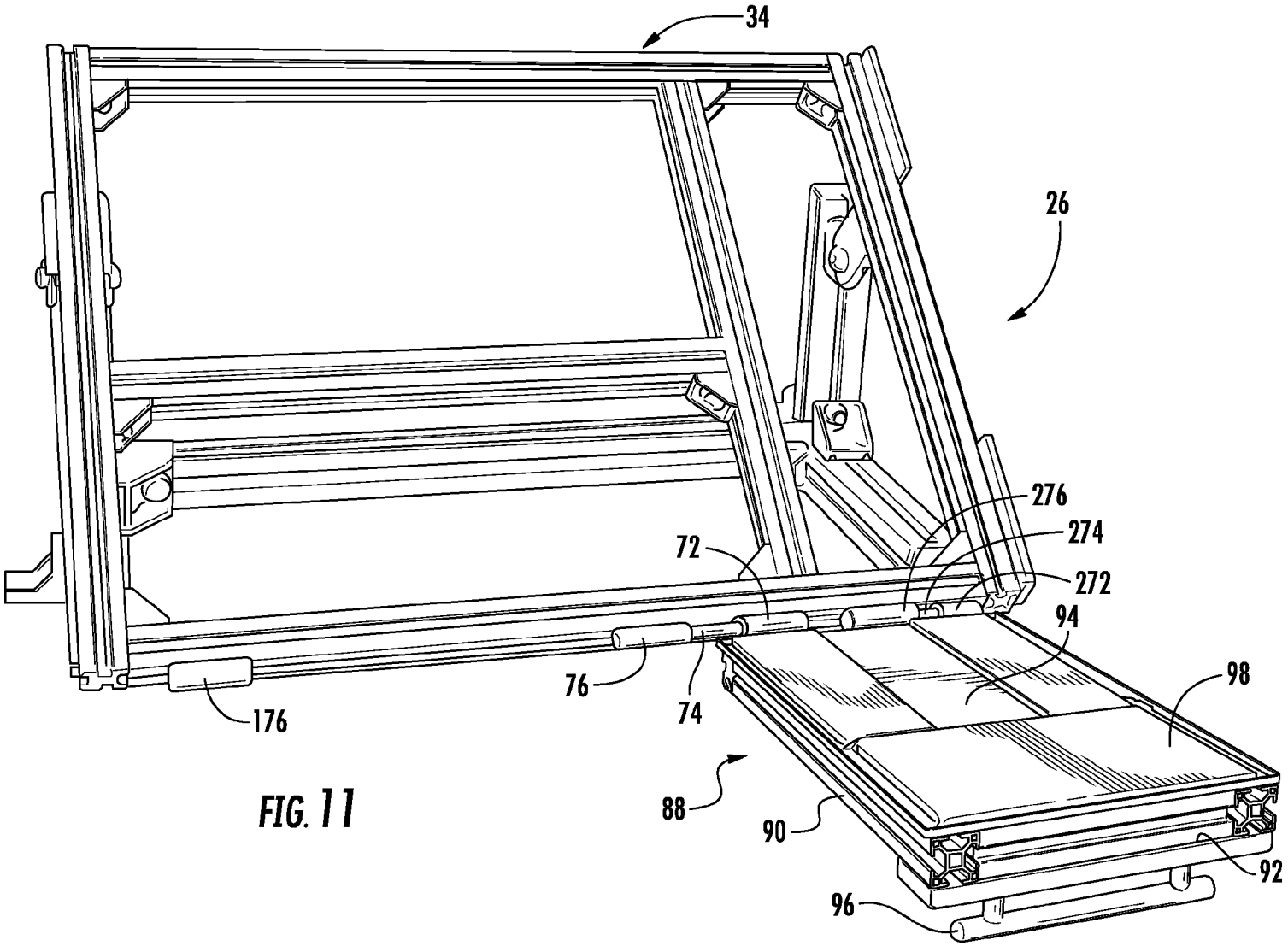
FIG. 11 is a perspective view of the window treatment apparatus illustrated in FIG. 2 with a second blocking element being mounted thereto.

The second blocking element may be seen mounted to the window stand 34 in FIG. 11. There, and with reference to FIG. 14, it can be seen that the second blocking element 88 includes two generally vertically extending side rails 90 separated and supported by horizontal side rails 92. A second cover plate 94 is mounted to the thusly formed framework and a handle 96 is provided for ease of movement of the second blocking element 88 in a manner similar to the first blocking element 58.

Figure 5:
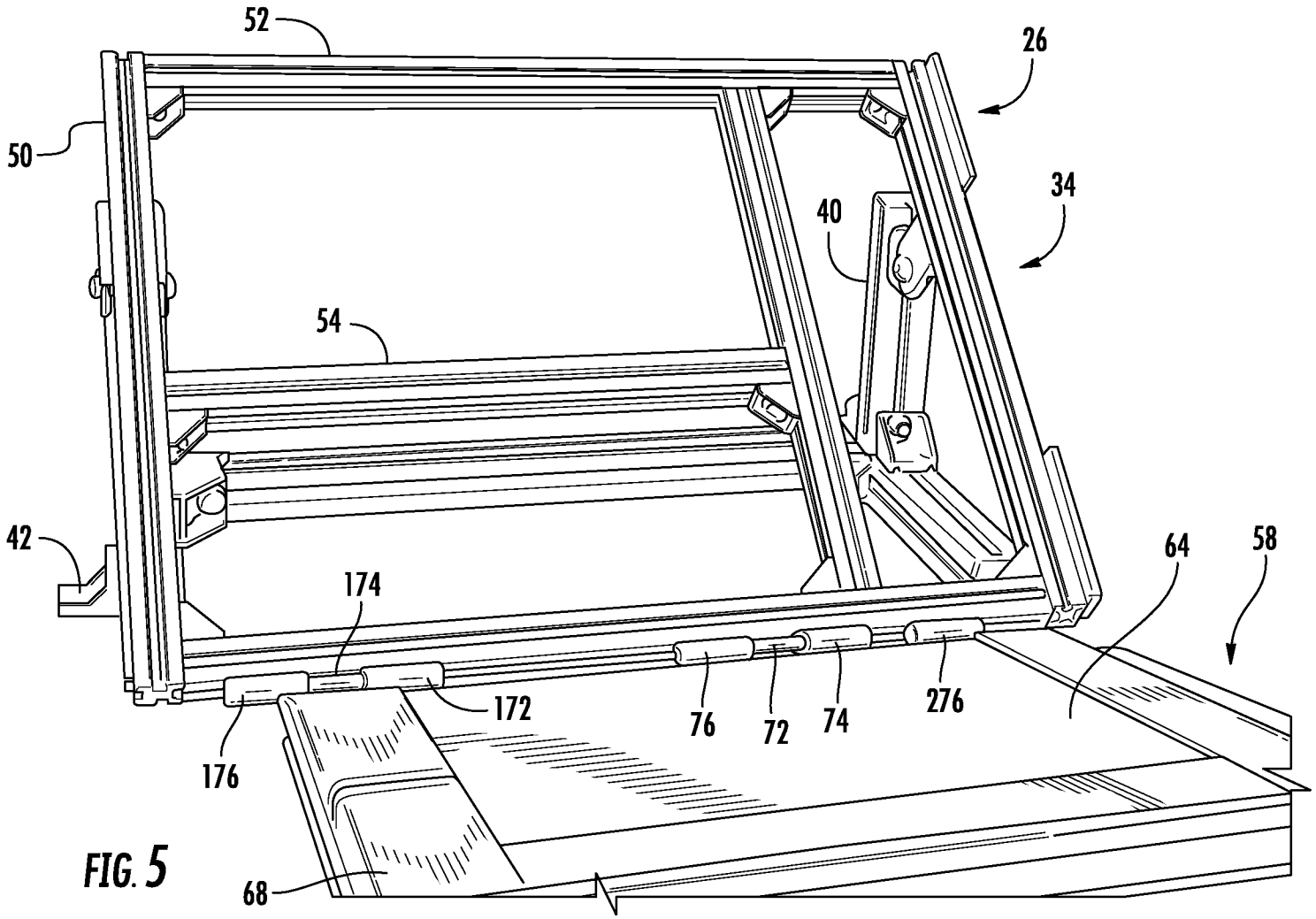
FIG. 5 is a perspective view of the window treatment apparatus having a first blocking element attached thereto and pivoted away from the support stand.
Figure 8:
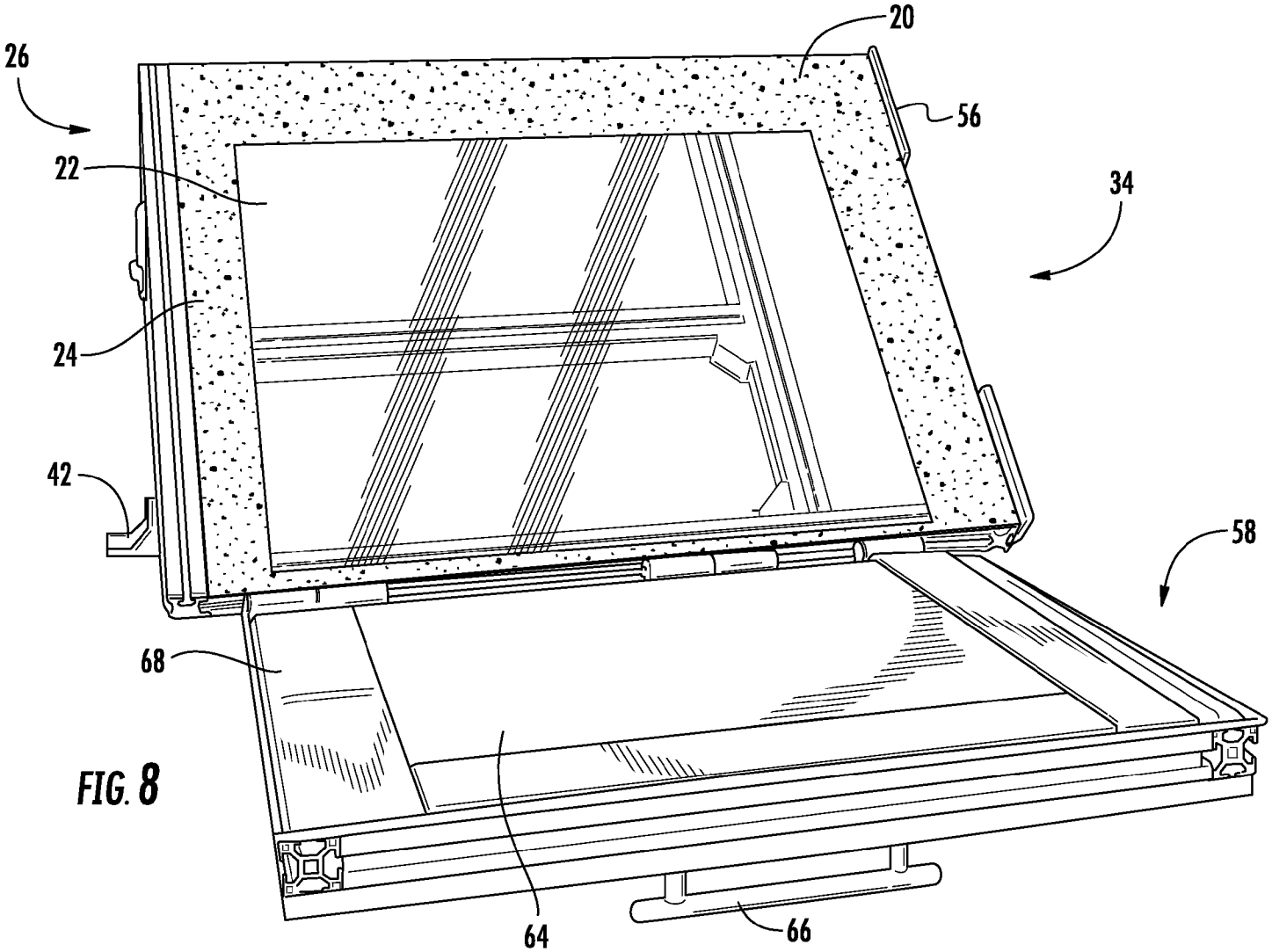
FIG. 8 is a perspective view of the window treatment apparatus having a treated window portion on the support stand and a blocking element pivoted away from the window.
Figure 9:
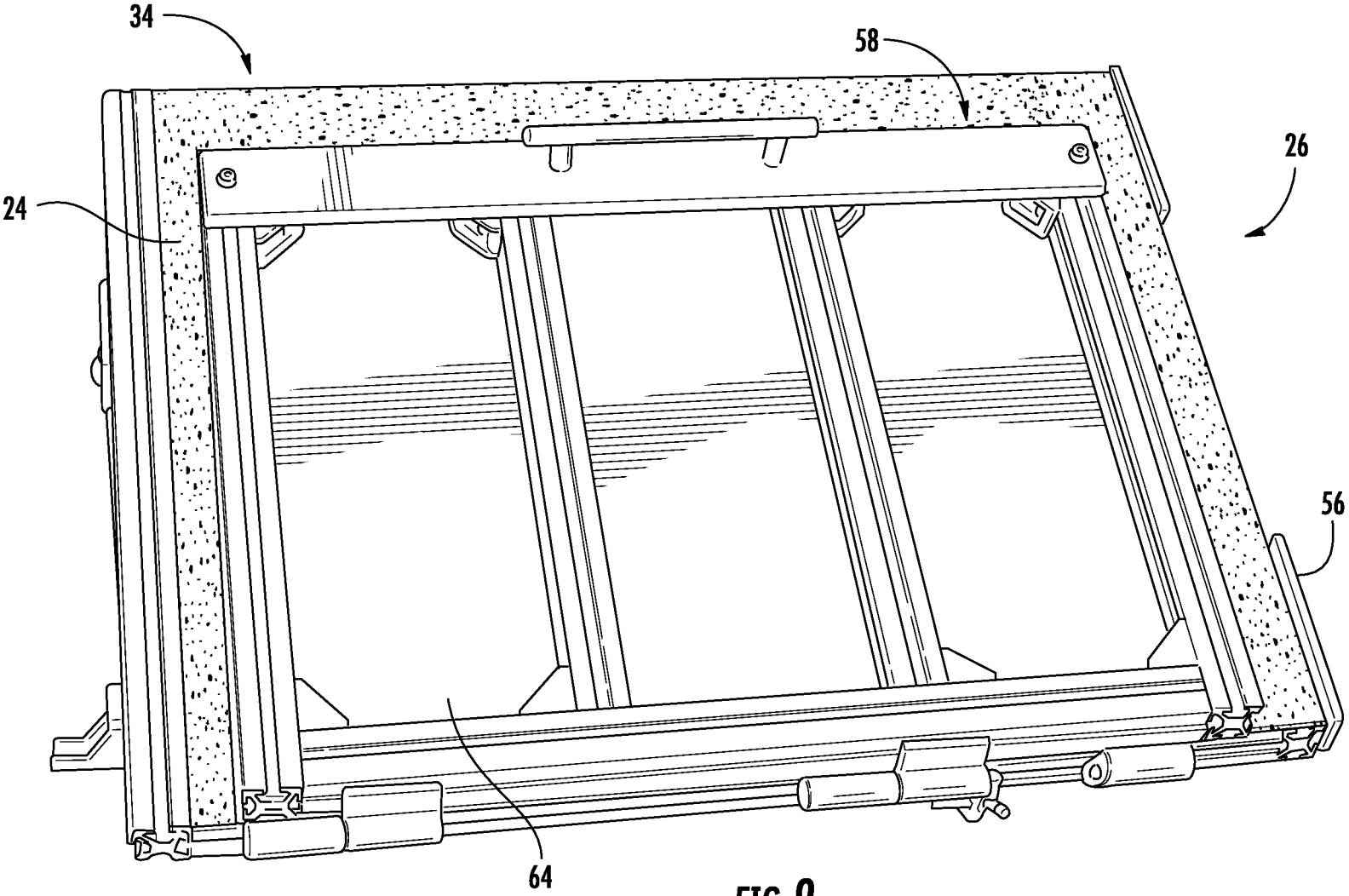
FIG. 9 is a perspective view of a window glass on the window treatment stand with the blocking element in place defining a window treatment area.

In order to prepare a glass sheet for use as a window in the home appliance of the present invention and according to the method of the present invention, the treatment apparatus 26 is set up in a manner illustrated in FIG. 5. Initially, the size of the window should be noted and a proper glass sheet selected to be used as a window once treated. Further, the size of the treatment area should be noted and a proper blocking element selected. FIG. 5 illustrates the larger, first blocking element 58 being moved into place on the window stand 34 by engaging the pin 74 of the first hinge element 72 with the receiver 76. The blocking element 58 is then moved laterally into place and the latch 84 moved into a locking relationship as seen in FIG. 6. The resultant configuration is seen in FIG. 7 prior to insertion of the glass sheet. Turning now to FIG. 8, the blocking element 58 is open and a glass window 20 is moved into place with the window sheet 20 moved against the alignment elements 56. It should be noted that the glass sheet illustrated in FIG. 8 is shown in a treated condition for clarity and to illustrate the treated portion 24. Turning now to FIG. 9, the first blocking element is rotated into place against the window which leaves the treatment portion 24 exposed for treatment.

Figure 10:
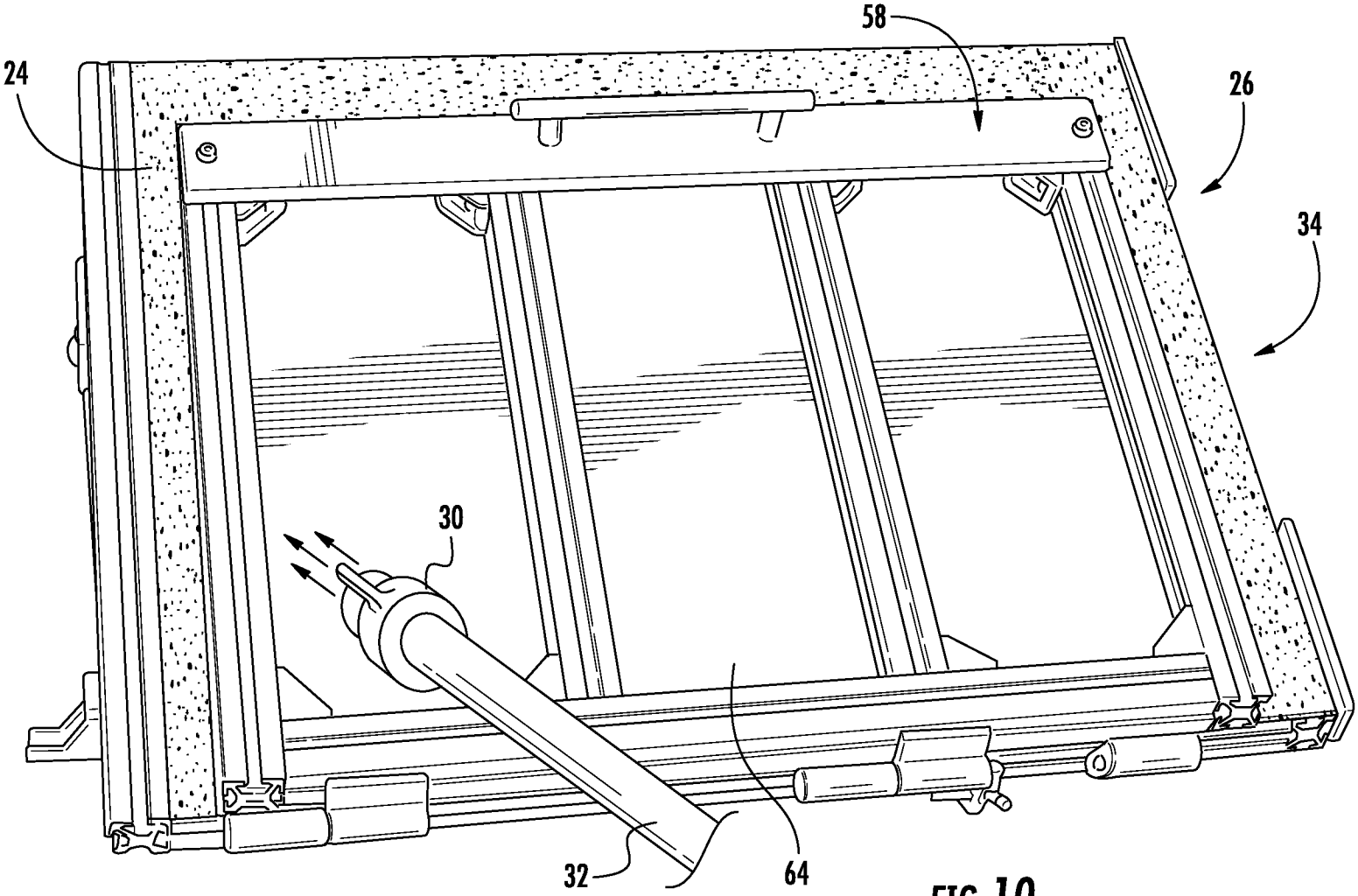
FIG. 10 is a perspective view of the window treatment apparatus illustrated in FIG. 9 with a window treatment apparatus.

Turning now to FIG. 10, a treatment gun 30 includes a hose 32 attached thereto for directing abrasive at the exposed window portion 24. The abrasive or blast medium may be aluminum oxide number 36 grit or any other appropriate abrasive that will result in disfiguring the glass to render it opaque or semi-opaque in a desired manner.

Figure 12:
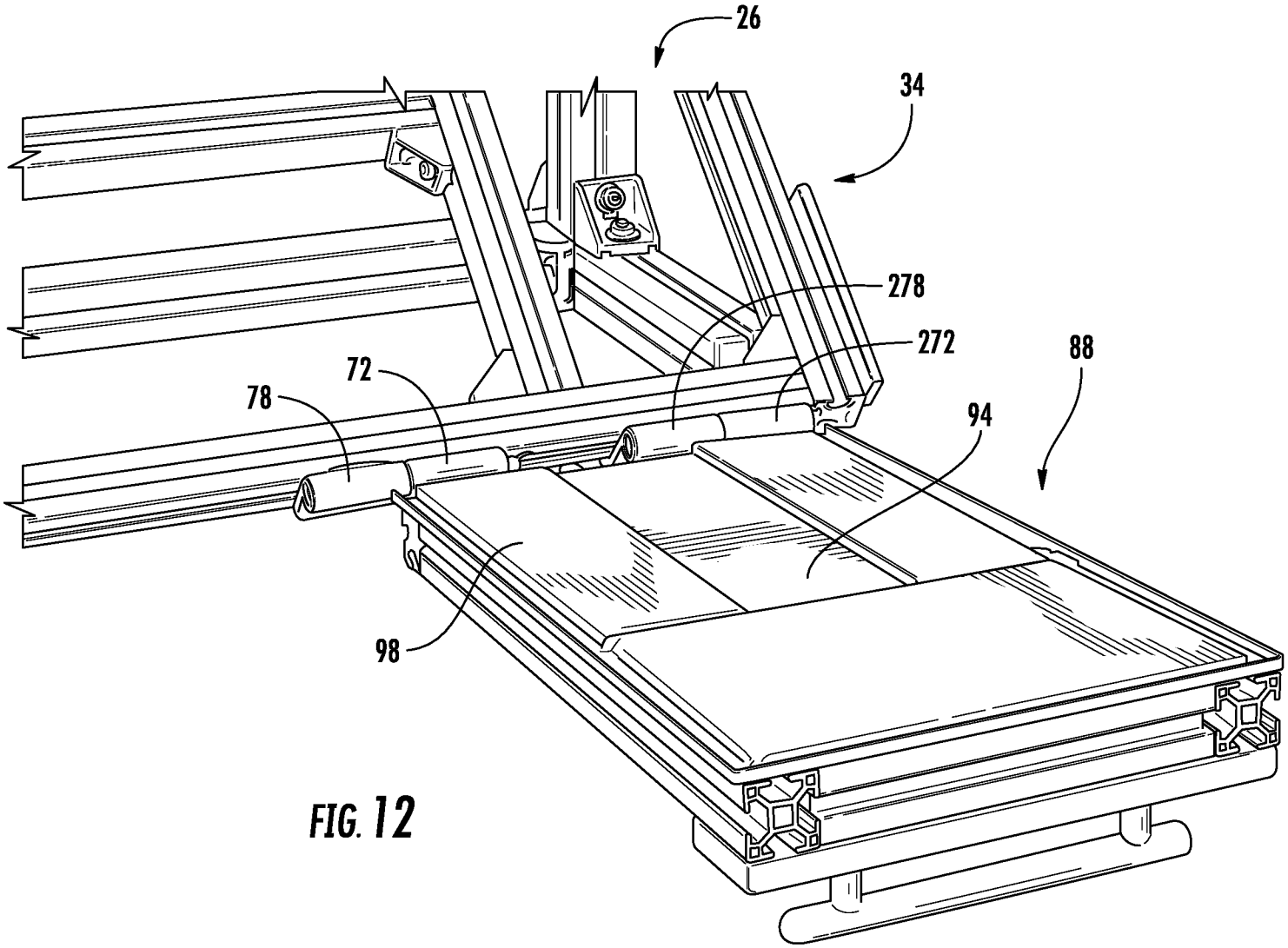
FIG. 12 is a perspective view of the second blocking element attached to the window treatment apparatus of FIG. 2.

Turning now to FIG. 11, for a second smaller window, or a different treatment area, the smaller, second blocking element 88 is mounted to the window stand 34 in a matter similar to the first blocking element 58. As seen in FIG. 12, the second hinge element 80 is fitted to the common receiver 78 and is latched in place as earlier described.

Figure 13:
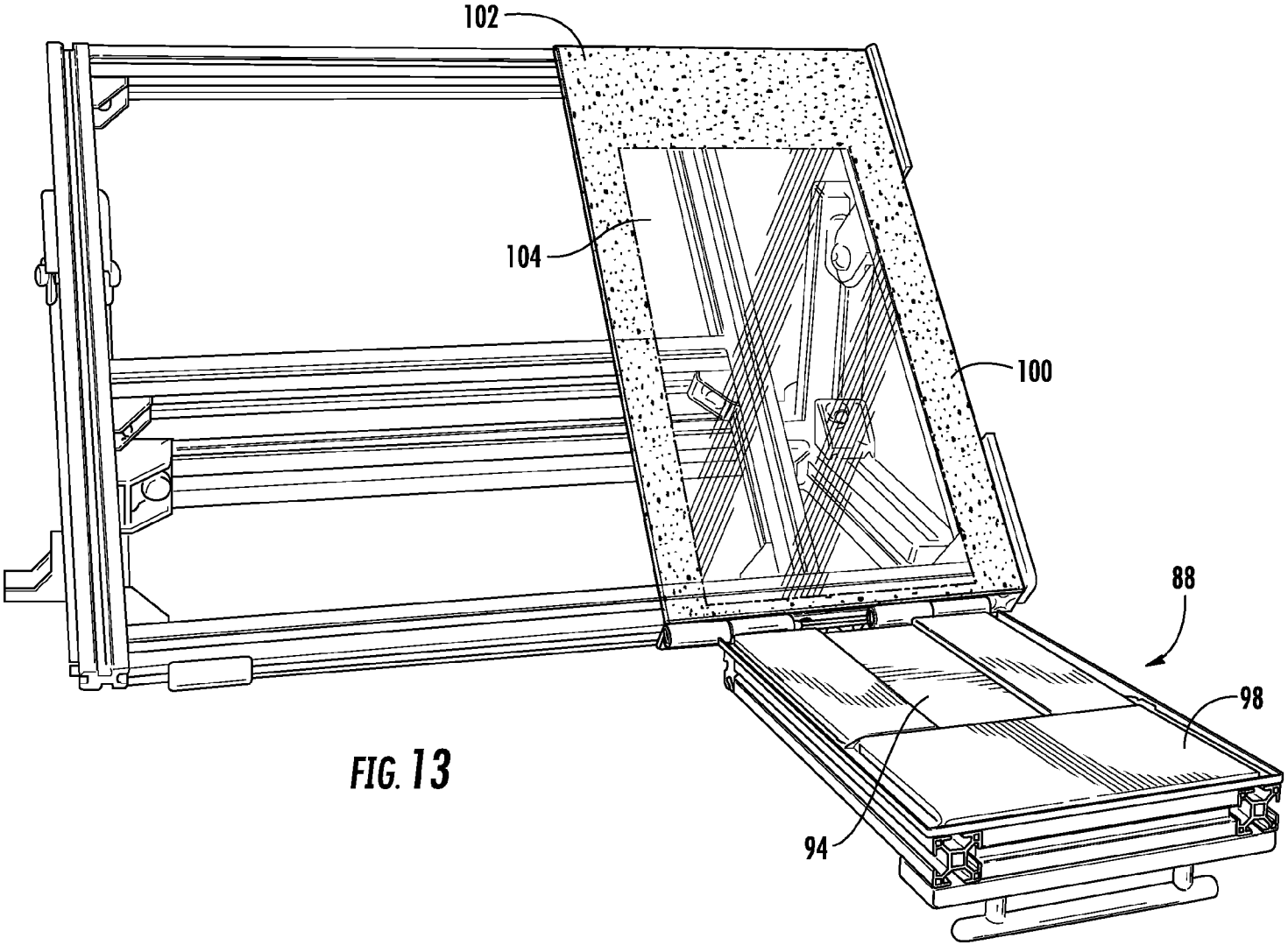
FIG. 13 is a perspective view of the window treatment apparatus having a second sized glass mounted thereto for treatment.
Figure 14:
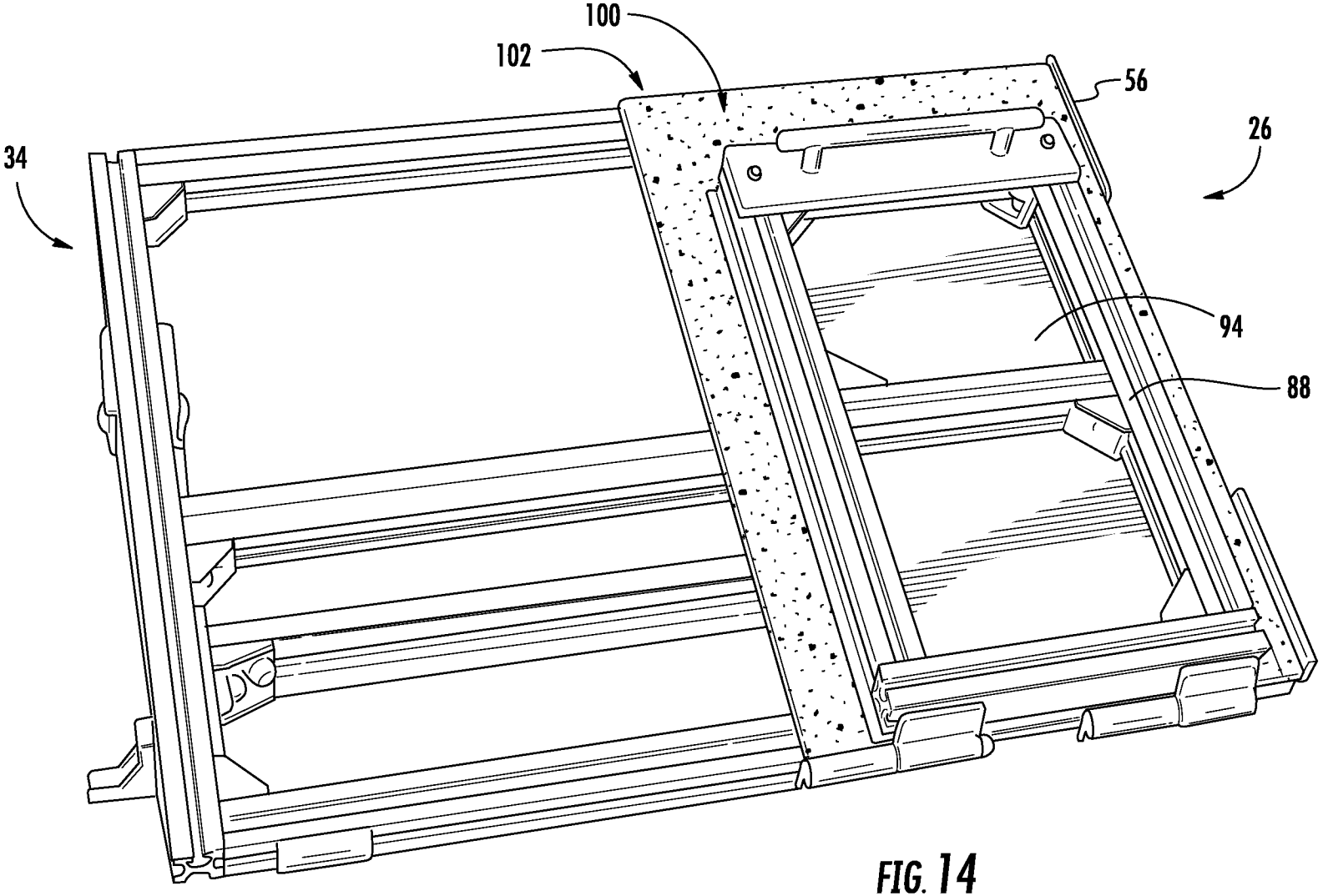
FIG. 14 is a perspective view of the window treatment apparatus illustrated in FIG. 13 with the blocking element in place.

With reference to FIG. 13, a smaller glass sheet for use as the second window 100 has a different sized treatment area 102 and a viewing area 104. Once again, the treatment area 102 is show in a treated manner for clarity and it will be understood by those skilled in the art that prior to treatment, the entire glass sheet is clear. The second window 100 is moved against the alignment braces for proper positioning. Turning now to FIG. 14, the second blocking element 88 is rotated into covering relation with the second window 100 exposing the second treatment area 102 for treatment.

Figure 15:
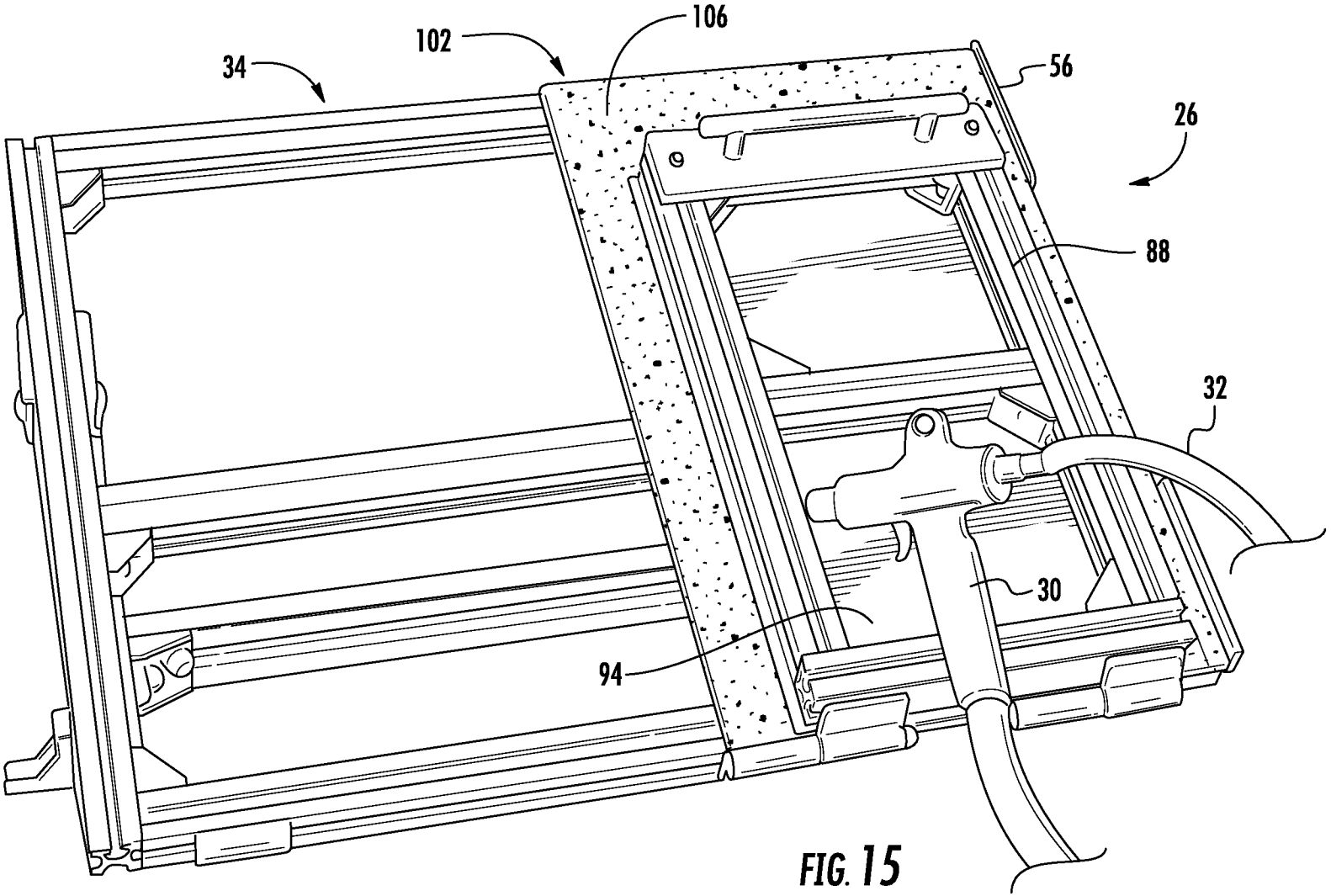
FIG. 15 is a perspective view of the window treatment apparatus illustrated in FIG. 14 with the treatment apparatus.

As seen in FIG. 15, the treatment gun 30 with the abrasive delivery hose 32 is moved into position by user and the abrasive grit is applied to the treatment area 102 in order to provide a treated window surface 106 in the exposed area.

From the above, it can be seen that the size of the blocking element 58, 88 defines the inner boundaries of the treatment area while the glass edge defines the outer boundaries of the treatment area. In order to change the size of the treatment area, a user can select a different blocking element, a different glass sheet size or both. It is the combination of the size of the glass sheet and the blocking element that determines the treatment area that receives the abrasive grit.

By the foregoing, the present home appliance includes windows treated by versatile apparatus that can be adapted to both large and small window glasses and larger or smaller treatment areas to provide an attractive appearance to an oven viewing window. It should be appreciated that not only is the present home appliance a range with ovens or other cavities, the appliance can also be a dishwasher, laundry washer, laundry dryer or any other home appliance that utilizes a viewing window and needs an attractive opaque or semi-opaque border applied in a straightforward and efficient manner.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance comprising:

an appliance body having an internal oven cavity and an oven access opening;

an oven door for selectively covering the oven access opening; and a window in the oven door for viewing the oven contents, the window including a treated window portion for obscuring a view of oven structure located behind the treated window portion, the window portion being treated prior to assembly in the home appliance on a window treatment apparatus for supporting a window element for treatment, the window treatment apparatus including a window support stand defining a window support area, and a blocking element pivotably mounted to the window stand for movement of the blocking element between a covering relation with a predetermined portion of the window support area for covering a predetermined portion of the window support area during abrasive treatment, and an uncovered relation with the window support area for uncovering the predetermined portion of the window support area after abrasive treatment, the blocking element including a window cover plate movable with the blocking element and having a window cover area smaller in area than the window support area, wherein the difference in the area of the window support area and the window cover area define a window treatment area.

2. The home appliance of claim 1 wherein the home appliance includes the window treated on the window treatment apparatus wherein the window treatment apparatus includes a first blocking element pivotably and removably mountable to the window support frame and a second blocking element pivotably and removably mountable to the window support frame, wherein the first blocking element has a first window cover area and the second blocking element has a second window cover area and the first window cover area is a different size that the second window cover area.

3. The home appliance of claim 1 wherein the home appliance includes the window treated on the window treatment apparatus by applying abrasive blasting to the window treatment area.

4. The home appliance of claim 2 wherein the home appliance has one of a first window made from a glass sheet having a first size with a treated window portion with a first size and the treated on the window treatment apparatus using the first blocking element and a second window made from a glass sheet having the first size and a treated window portion having a second size and treated on the window treatment apparatus using the second blocking element.

5. The home appliance of claim 2 wherein the home appliance has one of a first window made from a glass sheet having a first size and treated on the window treatment apparatus using a first blocking element and a second window made from a glass sheet having a second size and treated on the window treatment apparatus using a second blocking element.

6. The home appliance of claim 1 wherein the home appliance is a range.

7. An apparatus for use in abrasively treating glass for home appliance use, the apparatus comprising:

a window support stand defining a window support area and a blocking element pivotably mounted to the window stand for movement of the blocking element between a covering relation with a predetermined portion of the window support area for covering a predetermined portion of the window support area during abrasive treatment, and an uncovered relation with the window support area for uncovering the predetermined portion of the window support area after abrasive treatment, the blocking element including a window cover plate movable with the blocking element and having a window cover area smaller in area than the window support area, wherein the difference in the area of the window support area and the window cover area define a window treatment area.

8. The apparatus according to claim 7 wherein the apparatus includes a first blocking element pivotably and removably mountable to the window support frame and a second blocking element pivotably and removably mountable to the window support frame, wherein the first blocking element has a first window cover area and the second blocking element has a second window cover area and the first window cover area is a different size that the second window cover area.

9. The apparatus of claim 7 wherein the window treated on the window treatment apparatus is a glass sheet mounted on the window treatment stand and partially covered by the blocking element, thereby leaving the window treatment area exposed for treatment.

10. The apparatus of claim 7 wherein the window support stand includes a skeletal base and a window support wherein the window support is mounted to the skeletal base at an adjustable angular relationship with a horizontal plane.

11. The apparatus of claim 7 wherein the treatment apparatus includes a padded surface on one side of the blocking element for abutment with a glass sheet for treatment thereof.

12. The apparatus of claim 7 wherein the treatment apparatus includes alignment members mounted to one side of the window support stand for alignment of a glass sheet for treatment thereof.

13. The apparatus of claim 7 wherein the treatment apparatus includes a hinge system for mounting the blocking element on the window support stand.

14. The apparatus of claim 8 wherein the hinge system for mounting the blocking portion on the window support stand is configured to mount two blocking elements on the window support stand and includes a first hinge portion for association with a first blocking element and a second hinge portion for association with a second blocking element and a common hinge portion for association with both the first blocking element and the second blocking element.

15. The apparatus of claim 14 wherein each hinge portion includes a pin mounted to one of the window treatment stand and the blocking element and a pin receiver for receipt of the pin, with the pin receiver being mounted to one of the window treatment stand and the blocking element.

16. A home appliance comprising:

an appliance body having an internal oven cavity and an oven access opening;

an oven door for selectively covering the oven access opening; and a window in the oven door for viewing the oven contents, the window including a treated window portion for obscuring a view of oven structure located behind the treated window portion, the treated window prepared by a process comprising the steps of:

selecting a glass sheet of suitable size for use as a viewing window in the home appliance;

mounting the glass sheet to a window treatment apparatus including a window support stand defining a window support area;

selecting a blocking element having a cover plate movable with the blocking element, the cover plate having a window cover area smaller in area than the window support area of suitable size to cover a portion of the glass sheet, wherein the difference in the area of the window support area and the window cover area to define a window treatment area;

pivotably mounting the blocking element to the window treatment apparatus wherein the blocking element is movable of between a covering relation with a predetermined portion of the window support area for covering a predetermined portion of the window support area during abrasive treatment, and an uncovered relation with the window support area for uncovering the predetermined portion of the window support area after abrasive treatment;

covering a selected portion of the glass sheet with the blocking element by moving the blocking element over the glass sheet;

treating the glass sheet in the defined window treatment area using a treating apparatus.

* * * * *